US009368919B2

(12) United States Patent
Dieβel et al.

(10) Patent No.: US 9,368,919 B2
(45) Date of Patent: Jun. 14, 2016

(54) PLUG CONNECTOR COMPRISING A PROTECTIVE CONDUCTOR BRIDGE

(71) Applicant: PHOENIX CONTACT GMBH & CO. KG, Blomberg (DE)

(72) Inventors: Thorsten Dieβel, Hiddenhausen (DE); Detlef Nehm, Schieder-Schwalenberg (DE); Martin Kneidl, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/383,097

(22) PCT Filed: Mar. 5, 2013

(86) PCT No.: PCT/EP2013/054410

§ 371 (c)(1),
(2) Date: Sep. 4, 2014

(87) PCT Pub. No.: WO2013/131918

PCT Pub. Date: Sep. 12, 2013

(65) Prior Publication Data

US 2015/0024621 A1 Jan. 22, 2015

(30) Foreign Application Priority Data

Mar. 5, 2012 (DE) ..... 10 2012 101 813

(51) Int. Cl.
*H01R 13/627* (2006.01)
*H01R 13/655* (2006.01)
(Continued)

(52) U.S. Cl.
CPC ..... *H01R 13/655* (2013.01); *H01R 13/432* (2013.01); *H01R 13/502* (2013.01); *H01R 13/516* (2013.01); *H01R 13/53* (2013.01); *H01R 24/22* (2013.01); *H01R 24/30* (2013.01)

(58) Field of Classification Search
CPC .. H01R 13/502; H01R 13/432; H01R 13/434; H01R 13/346; H01R 13/3464; H01R 13/516; H01R 13/53
USPC ..... 439/353, 352, 345, 368, 369, 372, 953
See application file for complete search history.

(56) References Cited

U.S. PATENT DOCUMENTS 3,566,336 A * 2/1971 Johnson ..... H01R 13/6275 439/353
5,080,603 A * 1/1992 Mouissie ..... H01R 23/10 439/353

(Continued)

FOREIGN PATENT DOCUMENTS

DE 20 33 011 A 1/1972
DE 10 2005 019 245 B3 3/2007

(Continued)

OTHER PUBLICATIONS

International Preliminary Report on Patentability and Written Opinion of the International Searching Authority (German language) as well as English-langugae translation of the Written Opinion in related PCT patent application No. PCT/EP2013/054410, dated Sep. 9, 2014, 10 pages.

(Continued)

*Primary Examiner* — Abdullah Riyami
*Assistant Examiner* — Harshad Patel
(74) *Attorney, Agent, or Firm* — Knobbe Martens Olson & Bear LLP

(57) ABSTRACT

The innovations relate to a plug connector (1) for mechanical and electrical connection to a corresponding mating plug connector, comprising a housing (2), a protective conductor bridge (3) and a plug insert, wherein the protective conductor bridge (3) is held on the housing (2), wherein the protective conductor bridge (3) has at least one connection region (9) for connection to the plug insert, and the plug insert is held on the at least one connection region (9).

20 Claims, 4 Drawing Sheets

Figure 1:
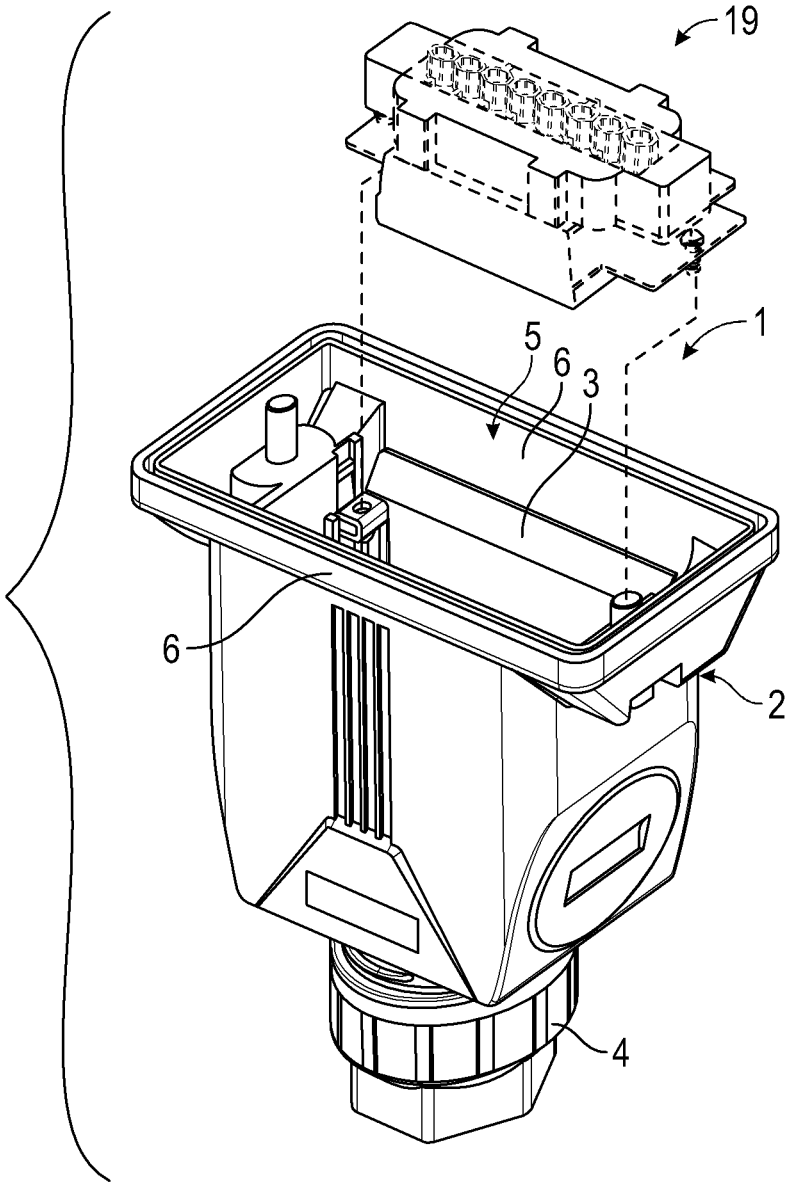

(51) Int. Cl.

| | |
|---|---|
| ***H01R 13/432*** | (2006.01) |
| ***H01R 13/502*** | (2006.01) |
| *H01R 13/516* | (2006.01) |
| *H01R 13/53* | (2006.01) |
| *H01R 24/22* | (2011.01) |
| *H01R 24/30* | (2011.01) |

(56) References Cited

U.S. PATENT DOCUMENTS

| | | | | |
|---|---|---|---|---|
| 5,603,639 | A * | 2/1997 | Lai | H01R 23/6873 439/353 |
| 6,004,163 | A | 12/1999 | Behling et al. | |
| 2009/0088010 | A1 * | 4/2009 | Smith | H01R 13/5205 439/136 |

FOREIGN PATENT DOCUMENTS

| | | | |
|---|---|---|---|
| DE | 10 2010 017 717 | A1 | 1/2012 |
| JP | 2000-502495 | A | 2/2000 |

OTHER PUBLICATIONS

International search report (in German) and it's translation in related PCT patent application No. PCT/EP2013/054410, dated May 30, 2013, 5 pages.

Office Action received in German counterpart application No. 10 2012 101 813.8, dated Jan. 18, 2013, 4 pgs.

Office Action issued by the Japanese Patent Office in Application No. JP2014-560337 on Mar. 24, 2016, and English language translation thereof; 7 pgs.

* cited by examiner

PLUG CONNECTOR COMPRISING A PROTECTIVE CONDUCTOR BRIDGE

CROSS-REFERENCE TO RELATED APPLICATIONS

This application is a U.S. National Stage Application of International Application No. PCT/EP2013/054410 filed Mar. 5, 2013, published as WO2013/131918, which claims priority from German Patent Application No. 10 2012 101 813.8, filed Mar. 5, 2012, which are incorporated herein by reference in entirety.

The present inventions relate to a plug connector for mechanical and electrical connection to a corresponding mating plug connector, comprising a housing, a protective conductor bridge and a plug insert, wherein the protective conductor bridge is held on the housing.

Plug connectors and mating plug connectors of this type are used in the prior art in order to produce an electrical and mechanical connection between two electrical cables or between an electrical cable and a device or an installation. In particular for the transmission of large currents, large heavy plug connectors are necessary, which are protected against ambient influences by the housing. Such housings normally consist of aluminium and are provided with a thread for receiving a cable gland. The plug connectors considered here are configured for the connection of a plurality of electrical cables, of which one is a protective conductor (PE contact). Combined with a neutral conductor, the protective conductor may also be configured as a PEN contact. The protective conductor is connected to the protective conductor bridge in order to enable a corresponding protective conductor function and in order to bring the protective conductors of the plug connector and mating plug connector into contact with one another. The other cables are connected to electrical contacts of the plug insert.

The primary construction of plug connectors and mating plug connectors may be substantially identical and may differ merely in the embodiment of the electrical contacts of said connectors for producing the electrical connection. The embodiments for the plug connector thus apply accordingly for the mating plug connector.

Plug connectors and mating plug connectors are configured correspondingly in accordance with the plug/socket principle for the production of an electrical connection between the plug connector and the mating plug connector. The electrical contacts of the plug connector and mating plug connector can each be configured correspondingly as contact pins or contact pin receptacles For reliable electrical connection of the conductors of the plug connector and mating plug connector, the plug insert is positioned fixedly on the housing.

A disadvantage of the previously described plug connector is that the mounting of the protective conductor bridge and of the plug insert is complex, and assembly space has to be kept free in the housing in order to mount both the plug insert and the protective conductor bridge. It is thus necessary to configure the plug connector so as to be accordingly large. In addition, such plug connectors are often heavy, which impairs the handling thereof.

Proceeding from the above prior art, the object of the invention is therefore to specify a plug connector of the above-mentioned type that can be produced easily and cost-efficiently and that can be easily handled and enables a reliable mechanical and electrical connection of plug connector and mating plug connector.

The object is achieved in accordance with the invention by the features of the independent claim. Advantageous embodiments of the invention are specified in the dependent claims.

In accordance with the invention, a plug connector for mechanical and electrical connection to a corresponding mating plug connector is thus specified, comprising a housing, a protective conductor bridge and a plug insert, wherein the protective conductor bridge is held on the housing, the protective conductor bridge has at least one connection region for connection to the plug insert, and the plug insert is held on the at least one connection region.

The basic concept of the present invention is thus to simplify the mounting of the plug connector by mounting the protective conductor bridge in and directly on the housing and by mounting the plug insert in the housing directly on the protective conductor bridge. By way of example, the protective conductor bridge is initially attached separately to the housing, and the plug insert is attached in a further mounting step to the protective conductor bridge already mounted. The plug connector thus formed can be easily mounted and requires little space for the installation. The weight of the plug connector is thus also low. The mounting of the plug insert is primarily independent of the order of the introduction of plug insert and protective conductor bridge into the housing. In a preferred embodiment, the plug connector is configured in such a way that the plug insert is first mounted on the protective conductor bridge and the unit thus formed can then be mounted as a whole in the housing. The protective conductor bridge and contacts of the plug insert are connected to individual conductors, for example individual conductors of a cable to be connected, wherein the protective conductor bridge is connected to a protective conductor, also referred to as a PE conductor. Further conductors are connected to electrical contacts of the plug insert. The plug insert can be configured for contacting of the mating plug connector to contact pins or corresponding receptacles for the contact pins, or to any other corresponding contacts. The plug connector and the mating plug connector can thus be configured for example in accordance with the plug/socket principle either as male or female plugs, without the need for distinction for the mounting according to the invention of the plug insert or protective conductor bridge. The protective conductor may also be configured as a PEN (protected earth neutral) contact with integrated neutral conductor. The embodiments for the plug connector apply accordingly for the mating plug connector. The protective conductor bridge is suitable for reliable attachment of the plug insert, since said bridge is configured as an electrical conductor and is therefore usually produced from metal. The protective conductor bridge thus has high stability, such that a more robust and more reliable plug connector is produced.

In an advantageous embodiment of the invention, the plug connector is configured in such a way that the at least one connection region is configured to produce a screwed connection to the plug insert. The screwed connection enables a stable and reliable attachment of the plug insert to the protective conductor bridge. Various embodiments of the connection region are possible in order to produce the screwed connection, for example the connection region may have bolts with an external thread in order to screw on the plug insert. A screw can also be held on the connection region. Alternatively or additionally, it is also possible to configure the connection region for the production of a detent connection to the plug insert, such that the plug insert is latched to the protective conductor bridge.

In a further advantageous embodiment of the invention, the plug connector is formed in such a way that the at least one connection region has a through-hole. The through-hole makes it possible to pass through a connection screw or a stud bolt, such that the plug insert and the protective conductor bridge can be fastened to one another with production of a screwed connection.

In a further advantageous embodiment of the invention, the plug connector is formed in such a way that the through-hole is configured with an internal thread. The internal thread allows a screw to be screwed in directly, such that the plug insert can be attached easily to the protective conductor bridge with exclusive use of at least one screw having a corresponding external thread.

In a further advantageous embodiment of the invention, the plug connector is formed in such a way that the at least one connection region is fabricated from sheet metal. The sheet metal has a high stability, whereby the plug insert is held reliably on the protective conductor bridge and therefore on the housing.

In accordance with a preferred embodiment of the invention, the plug connector is configured in such a way that the at least one connection region is configured with a tubular body. The tubular body has high strength for the attachment of the plug insert. For example, the fastening can be implemented on an outer wall of the tubular body or on the tubular body as a whole. When the connection region is fabricated from sheet metal, the tubular embodiment can be formed for example by simple bending or folding of the sheet metal. The tubular body is preferably configured with a substantially rectangular cross section. The connection region is more preferably configured as a hollow body.

In a further advantageous embodiment of the invention, the plug connector is configured in such a way that the tubular body has two opposed through-holes, and one of the through-holes is configured with an internal thread. The two opposed through-holes allow the passage of fastening means in order to attach the plug insert to the connection region. A screw for fastening the plug insert can be used by the internal thread, whereas the second through-hole thread serves merely for guidance. The hollow space between the through-holes causes a spring effect, such that the plug insert is screwed to the protective conductor bridge in a reliable and durable manner.

In a further embodiment of the invention, the plug connector is formed in such a way that the through-hole with the internal thread is configured with a passageway. The passageway makes it possible to provide a thread region with a greater thread length and a higher number of thread turns than is the case with the through-hole alone. In particular when the connection region is fabricated from sheet metal, a short thread length is normally produced due to the material thickness of the sheet and can be increased by the passageway. For example at the connection region made of sheet metal by means of a corresponding formation of the through-hole, the passageway can be produced easily from the sheet metal. Alternatively, the passageway can be fastened to the metal sheet as a separate component, for example by welding, soldering or other connection methods.

In a further advantageous embodiment of the invention, the plug connector is configured in such a way that the protective conductor bridge has two connection regions, which are formed at the axial end regions of said bridge. Due to the two connection regions, a reliable and durable fastening of the plug insert to the protective conductor bridge is obtained. At the same time, the protective conductor bridge can be tensioned by the plug insert via the connection regions, such that said bridge is not subject to the risk of deformation. The connection regions at the end regions are preferably formed in the longitudinal axis of the protective conductor bridge.

In accordance with a preferred embodiment of the invention, the plug connector is formed in such a way that the protective conductor bridge has an elongate bridge main body and the at least one connection region is formed laterally on the bridge main body. Due to the lateral attachment of the connection region to the bridge main body, the protective conductor bridge can be attached for example along a wall of the housing, and the connection regions may protrude from the protective conductor bridge into an interior of the housing. The plug insert can thus be attached easily to the protective conductor bridge. The protective conductor bridge and the connection regions are particularly preferably arranged substantially at right angles to one another. The bridge main body may thus have its smallest thickness in a direction of insertion of the mating plug connector, whereas the connection region protrudes perpendicularly thereto into the housing in order to be able to attach the plug insert thereto easily and reliably. When the protective conductor bridge is fabricated from a resilient material, for example metal, the bridge main body is resiliently connected to the connection region, whereby the mounting of the plug connector is facilitated, since tolerances can be easily counterbalanced. In particular when a prefabricated unit formed of protective conductor bridge and plug insert is introduced into the housing, the movability of the bridge main body relative to the connection region facilitates the insertion. A canting during insertion of this unit into the housing can be prevented or counterbalanced.

In accordance with a preferred embodiment of the invention, the plug connector is configured in such a way that the at least one connection region has fastening means for connecting the protective conductor bridge to the housing. All fastenings can thus be implemented via the connection region, which promotes the construction of the housing with smaller dimensions. The fastening means can be formed arbitrarily, for example in the form of a through-opening with or without internal thread for screwing the protective conductor bridge to the housing at the connection regions. A through-hole is preferably formed in the connection region for simultaneous connection of the plug insert and of the housing to the protective conductor bridge. The fastening means are more preferably configured to create a force-locked or form-locked connection between the protective conductor bridge and the housing. By way of example, the at least one connection region may have a spring lug in order to produce a frictional connection to the housing.

In a further advantageous embodiment of the invention, the plug connector is configured in such a way that the fastening means are configured as detent means in order to latch with corresponding detent means of the housing. The detent means enable a simple fastening of the protective conductor bridge to the housing. In order to remove the protective conductor bridge from the housing, the latched connection can be released again easily. The detent means can be formed for example as detent lugs or tongues. A detent tab is particularly preferably formed at the connection region. The housing preferably has a guide groove with a detent lug, into which the detent tongue can be introduced and latched therein.

In a further advantageous embodiment of the invention, the plug connector is configured in such a way that the housing has a plug opening with two opposite sides, and a protective conductor bridge is attached to each of the two opposite sides, wherein the plug insert is held jointly on both protective conductor bridges. This embodiment of the plug connector makes it possible to reliably hold even a large plug insert in the housing, since support is provided on the opposite sides of the housing via the two protective conductor bridges. The mounting of a unit formed of plug insert and protective conductor bridges in the housing is also facilitated, since this unit can be easily introduced between the opposite sides. With a conical embodiment of the housing and/or a corresponding bending of the protective conductor bridges, this unit can be introduced into the housing in a self-centring manner. A protective conductor contact is provided on the two opposite sides by the respective protective conductor bridge and ensures a high level of safety for the plug connector. The plug connector can also be embodied in such a way that it is rotationally symmetrical, that is to say it can be connected identically to the mating plug connector with a rotation through 180° about the axis of the direction of insertion of the mating plug connector.

In accordance with a preferred embodiment of the invention, the plug connector is configured in such a way that the protective conductor bridge is produced integrally from a sheet metal. The embodiment made of sheet metal enables the production of a protective conductor bridge with little material consumption, wherein the sheet metal is easy to shape, for example by bending, folding or the like, in order to form the at least one connection region.

In a preferred embodiment of the invention, the plug connector is configured in such a way that the housing is produced from plastic. Compared with a metal housing, the housing made of plastic can be produced with reduced weight, whereby the plug connector can be easily handled. In addition, the plastic produces electrical insulation, which facilitates the use of the plug connector and increases safety.

The invention will be explained in greater detail hereinafter with reference to the accompanying drawing on the basis of preferred embodiments.

In the drawing

Figure 2:
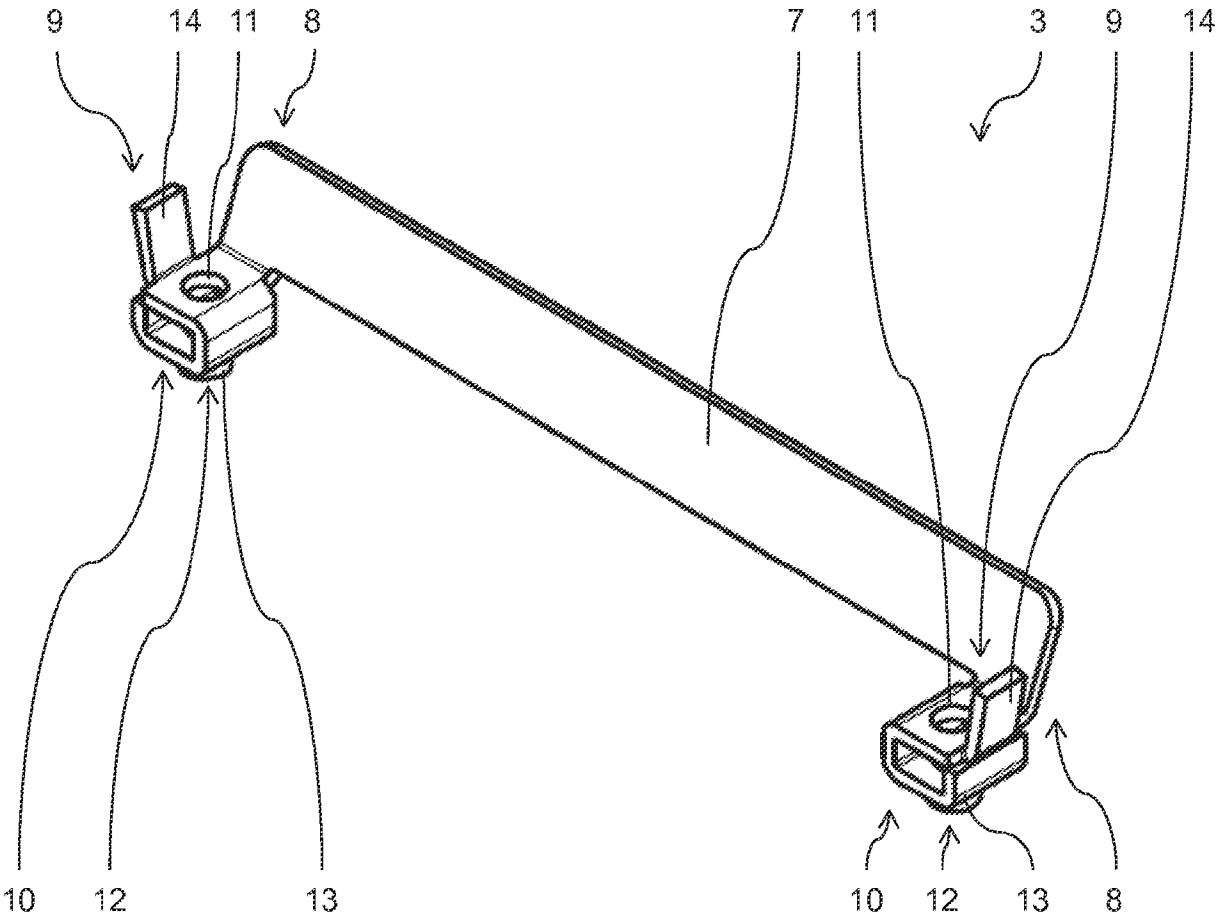
Figure 3:
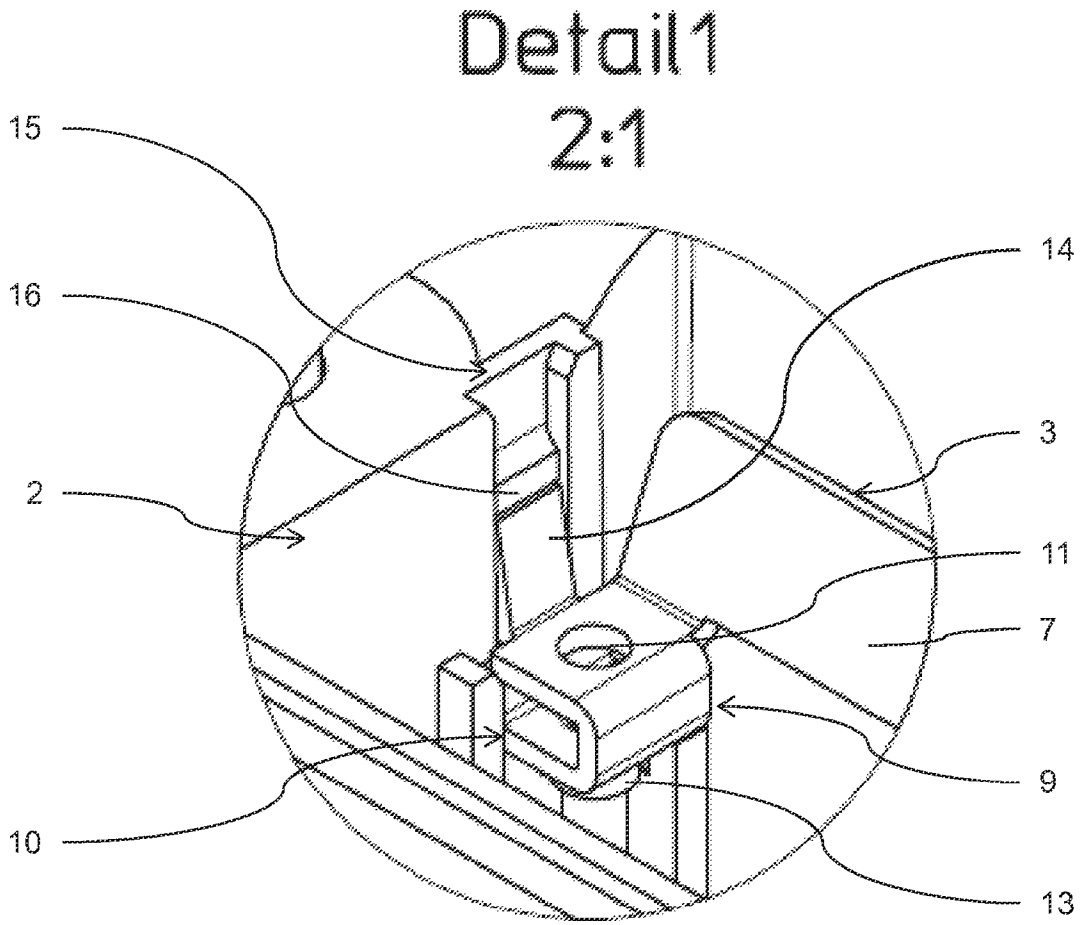
Figure 4:
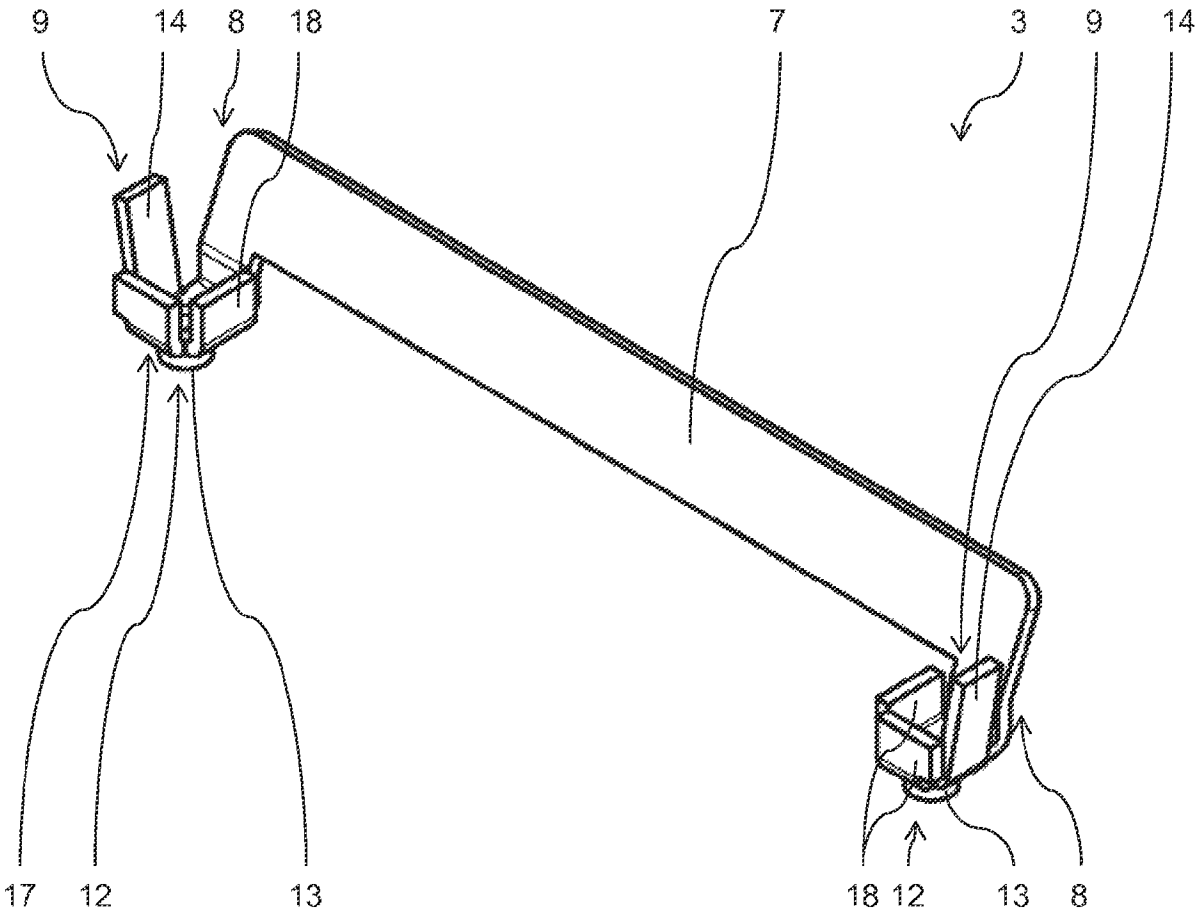

FIG. 1 shows a perspective view of a plug connector according to the invention in accordance with a first embodiment from the side of the plug opening thereof without attached plug insert, FIG. 2 shows a perspective view of the protective conductor bridge of the plug connector from FIG. 1 in an isolated illustration, FIG. 3 shows a detail of the view from FIG. 1 showing the attachment of the protective conductor bridge in the housing, and FIG. 4 shows a perspective view of a protective conductor bridge in accordance with a second embodiment of the invention in an isolated illustration.

FIG. 1 shows a plug connector 1 according to the invention in accordance with a first embodiment of the invention. The plug connector 1 comprises a housing 2, two protective conductor bridges 3, of which only one is visible in FIG. 1, and a plug insert 19. In the mounted state, the protective conductor bridges 3 and the plug insert are fixed in the housing 2, wherein, for example, electrical contacts of the plug insert may protrude from the housing 2.

The housing 2 is fabricated from plastic by means of injection molding and is configured with an integrally molded cable gland 4. The cable gland 4 is used to pass through a cable having a plurality of conductors into the housing 2. One of the conductors is a protective conductor which is connected to the protective conductor bridge 3, also referred to as a PE conductor. The further conductors are connected to electrical contacts of the plug insert. The plug insert is configured to contact a corresponding mating plug connector (not shown here) having contact pins or corresponding receptacles for contact pins.

The housing 2 has a plug opening 5, via which the plug connector 1 can be electrically and mechanically connected to the corresponding mating plug connector. The plug opening 5 is formed at right angles, wherein two opposite sides 6 of the plug opening 5, here the longitudinal sides, are arranged parallel to one another. The protective conductor bridges 3 are attached along the longitudinal sides 6 in the housing 2.

FIG. 2 shows one of the protective conductor bridges 3 in detail. Both protective conductor bridges 3 are identical to the protective conductor bridge 3 shown in FIG. 2.

The protective conductor bridge 3 from FIG. 2 is produced integrally from sheet metal and comprises an elongate bridge main body 7, at each of the axial end regions 8 of which a connection region 9 is formed. The connection regions 9 are positioned laterally on a common side on the bridge main body 7.

The connection regions 9 are formed in this exemplary embodiment with a tubular body 10, which has a rectangular cross section. The tubular body 10 of the connection regions 9 is formed in each case by bending the sheet metal of the protective conductor bridges 3 in the region of the connection regions 9.

The tubular body 10 has two opposite through-holes 11, 12, as is shown in detail in FIG. 3. The through-hole 11 shown at the top in FIG. 3 is formed as a through-hole without internal thread, whereas the through-hole 12 shown at the bottom in FIG. 3 is formed with a passageway 13, wherein the lower through-hole 12 and the passageway 13 have an internal thread. The plug insert can be mounted at the connection regions 9 of the protective conductor bridges 3 by means of four screws (not shown), wherein the screws are guided through the upper through-hole 11 and are screwed into the lower through-hole 12 having the passageway 13.

In addition, a detent tab 14 is formed at each of the connection regions 9 and is used to latch the protective conductor bridge 3 at the axial end regions 8 thereof in a guide groove 15 behind a detent protrusion 16 of the housing, as is shown in detail in FIG. 3. The protective conductor bridges 3 can thus be introduced individually or as a unit with the plug insert into the housing 2 through the plug opening 5 and can be mounted by producing the detent connection.

FIG. 4 shows a protective conductor bridge 3 in accordance with a second embodiment of the invention. The protective conductor bridge 3 of the second embodiment coincides substantially with the protective conductor bridge 3 of the first embodiment, such that it can be used in exchange for the protective conductor bridge 3 of the first embodiment in the housing 2 described below with reference to the first embodiment. For the sake of clarity, equivalent elements are denoted by the same reference signs. Since the protective conductor bridge 3 of the second embodiment coincides substantially with that of the first embodiment, only the differences will be discussed here.

The protective conductor bridge 3 of the second embodiment differs from that of the first embodiment in terms of the configuration of the connection regions 9 thereof. The connection regions 9 of the protective conductor bridge 3 of the second embodiment each have a base region 17. The sheet metal of the connection regions 9 is bent upwardly at the edges of the base region 17 in order to form a previously described detent tab 14 and side walls 18. A through-hole 12 with a passageway 13 as described previously is additionally formed in the base region 17 and has a corresponding internal thread.

There are no further differences between the protective conductor bridges 3 of the first and second embodiment.

LIST OF REFERENCE SIGNS

1 plug connector
2 housing
3 protective conductor bridge
4 cable gland
5 plug opening
6 opposite sides, longitudinal sides
7 bridge main body
8 end region
9 connection region
10 tubular body
11 upper through-hole
12 lower through-hole
13 passageway
14 detent tab, fastening means
15 guide groove
16 detent lug, detent means
17 base region
18 side wall
19 plug insert

The invention claimed is:

1. A plug connector for mechanical and electrical connection to a corresponding mating plug connector, comprising:

a housing, and a protective conductor bridge including at least one threaded through-hole having a diameter and shape to accept a corresponding threaded screw of a plug insert, wherein the protective conductor bridge is held in the housing, wherein the protective conductor bridge has at least one connection region for connection to the plug insert, wherein the at least one connection region is shaped to hold the plug insert on the at least one connection region, and wherein the plug connector is configured for connection of a plurality of electrical cables, one of the plurality of electrical cables being a protective conductor, wherein the protective conductor is connected to the protective conductor bridge.

2. The plug connector according to claim 1, wherein the at least one connection region is configured to produce a screwed connection to the plug insert.

3. The plug connector according to claim 2, wherein the at least one connection region has a through-hole.

4. The plug connector according to claim 3, wherein the through-hole is configured with an internal thread.

5. The plug connector according to claim 1, wherein the at least one connection region is fabricated from sheet metal.

6. The plug connector according to claim 1, wherein the at least one connection region is configured with a tubular body.

7. The plug connector according to claim 6, wherein the tubular body has two opposite through-holes, and one of the through-holes is configured with an internal thread.

8. The plug connector according to claim 4, wherein the through-hole with the internal thread is configured with a passageway.

9. The plug connector according to claim 1, wherein the protective conductor bridge has two connection regions, which are configured at the axial end regions of said bridge.

10. The plug connector according to claim 1, wherein the protective conductor bridge has an elongate bridge main body, and the at least one connection region is formed laterally on the bridge main body.

11. The plug connector according to claim 1, wherein the at least one connection region has a fastener that connects the protective conductor bridge to the housing.

12. The plug connector according to claim 11, wherein the fastener is configured as a detent tab in order to latch with a corresponding detent lug of the housing.

13. The plug connector according to claim 1, wherein the housing has a plug opening with two opposite sides, and a protective conductor bridge is attached to each of the two opposite sides, wherein the plug insert is held jointly on both protective conductor bridges.

14. The plug connector according to claim 1, wherein the protective conductor bridge is formed integrally from sheet metal.

15. The plug connector according to claim 1, wherein the housing comprises plastic.

16. The plug connector according to claim 8 wherein the at least one connection region is configured with a screw-in connection to the plug insert.

17. The plug connector according to claim 8 wherein the at least one connection region is configured with a tubular body.

18. The plug connector according to claim 7, wherein the through-hole with the internal thread is configured with a passageway.

19. The plug connector according to claim 18 wherein the at least one connection region is configured with a screw-in connection to the plug insert.

20. The plug connector according to claim 18 wherein the at least one connection region is configured with a tubular body.

* * * * *